US005997314A

United States Patent [19]

Wallace et al.

[11] Patent Number: 5,997,314

[45] Date of Patent: Dec. 7, 1999

[54] METHOD AND APPARATUS FOR PROVIDING A DUAL PURPOSE CONNECTION FOR INTERFACE WITH AN ANTENNA OR CONNECTION INTERFACE

[75] Inventors: Raymond C. Wallace; Jose F. Olivas, both of San Diego; Susan M. Tidwell; Roger W. Berg, both of Carlsbad; Thomas A. Pitta; Darrin Marthens, both of San Diego, all of Calif.

[73] Assignees: Qualcomm Incorporated, San Diego, Calif.; Sony Electronics Inc., Park Ridge, N.J.

[21] Appl. No.: 08/990,847

[22] Filed: Dec. 15, 1997

[51] Int. Cl.[6] ..... H01R 9/09

[52] U.S. Cl. ..... 439/63; 439/581; 439/638; 343/703

[58] Field of Search ..... 439/63, 580, 581, 439/54, 638, 641, 642; 343/703

[56] References Cited

U.S. PATENT DOCUMENTS 5,551,080 8/1996 Chambers et al. ..... 455/348

5,659,889 8/1997 Cockson ..... 455/575

FOREIGN PATENT DOCUMENTS 2287615 3/1995 United Kingdom ..... H04B 17/00

*Primary Examiner*—Renee S. Luebke
*Assistant Examiner*—Hae Moon Hyeon
*Attorney, Agent, or Firm*—Russell B. Miller; Roger W. Martin; Charles D. Brown

[57] ABSTRACT

A connector interface provides direct connection from a wireless communication device to a coaxial connector. The wireless communication device has a housing with an antenna connector. The antenna connector has a hollow pseudo-cylindrical center providing an opening through the housing. The connector interface has a custom connector comprised of an outer conductive shell, a nonconductive spacer and a ground probe. The outer conductive shell is mounted on the printed circuit board. The nonconductive spacer is disposed within the hollow pseudo-cylindrical center of the outer conductive shell. When the connector interface is connected to the wireless communication device, the outer conductive shell contacts the antenna connector and the ground probe extends through the opening into the housing to connect electrically to a ground potential within the housing.

13 Claims, 8 Drawing Sheets

METHOD AND APPARATUS FOR PROVIDING A DUAL PURPOSE CONNECTION FOR INTERFACE WITH AN ANTENNA OR CONNECTION INTERFACE

BACKGROUND OF THE INVENTION

I. Field of the Invention

The present invention relates to wireless communication devices and production testing thereof. More particularly, the present invention relates to a novel and improved dual purpose connection for a wireless communication device which interfaces with an antenna in normal use and interfaces with a connector interface during production testing.

II. Description of the Related Art

Wireless communication devices are becoming increasingly prevalent, with cellular telephones being a particularly notable example. With these devices, radio-frequency (RF) signals are transmitted and received to create a communication link to the device. During the manufacture of such devices, it is necessary to functionally test the RF signal generation and reception circuitry as well as the signal processing circuitry prior to shipment of the device to a customer.

The typical testing procedure for such devices includes placing a small test antenna near the antenna installed on the wireless communication device. Test signals are passed between the two antennas to test sensitivity, output power, and other parameters of the RF circuitry and signal processing circuitry of the device. One such wireless communication device is a portable cellular telephone. A single cellular telephone may have two antennas each of which may be used to transmit and receive RF signals. These two antennas are typically embodied in a single antenna assembly such as a retractable monopole whip antenna for normal RF transmission and a small helical antenna which remains external to the telephone body, even when the monopole whip antenna is retracted within the telephone body. Either the monopole whip antenna or the helical antenna may be used to transfer RF signals during normal operation. An example of such a system is disclosed in U.S. Pat. No. 5,353,036 to Baldry. In addition, the helical antenna may be used for transmitting and receiving signals to and from a test antenna. Although acceptably precise measurements of cellular telephone performance characteristics can be made with this system under some conditions, it is difficult to prevent the accumulation of small errors in the manufacturing environment which degrade the quality of the results obtained. Furthermore, in the manufacturing environment, where many devices may be tested simultaneously, interference from neighboring RF sources can affect measurement accuracy.

In spite of the drawbacks of testing by the coupling of two antennas, wireless communication devices have not generally included suitable interface hardware for testing which does not rely on such coupling. In U.S. Pat. No. 5,394,162 to Korovesis, et al., these problems are considered in conjunction with the testing of cellular telephones mounted inside vehicles. In this case, the whip antenna is usually provided on an exterior surface of the vehicle, such as the rear window, to transfer the RF signals outside of the vehicle itself. In particular, Korovesis et al. describe an RF coupler with a ground plane having a hole in its center which is placed over the whip antenna interface on the rear window prior to installation of the whip. A semicircular contact is placed in electrical contact with the antenna interface base. Although this apparatus allows telephone testing without using the antenna, interference can still be a problem. To help minimize such interference, a mesh EMI shield is preferably placed over the test apparatus during use. The present invention is substantially less cumbersome compared to such an arrangement.

Thus, it will be appreciated that there is a need in the technology for a means and method for providing a connection between a wireless device under test and standard test equipment which overcomes the cumbersome nature of the prior art and which eliminates the need for radiated fields. The present invention provides a direct and efficient connection which is suitable for the production environment and which does not require an additional port on the device.

SUMMARY OF THE INVENTION

The present invention is a novel and improved interface for a wireless communication device. According to the present invention, a single port is used for connection to an antenna during normal use and to test equipment during production line testing. The use of a single interface for both the antenna and test equipment increases the convenience and reliability of production line testing. An interface connector provides a direct electrical coupling during test which eliminates the need for radiated fields during production test and, thereby, minimizes interference to and from other simultaneously performed testing. Furthermore, direct electrical coupling to the wireless communication device both improves the repeatability of and reduces the value of the coupling impedance, thereby increasing the accuracy and reliability of the test measurements. In one particularly suitable embodiment, the interface connector of the present invention is connected to a cellular telephone.

Accordingly, in one aspect of the present invention, a connector interface for conductively connecting RF signal circuitry of a wireless communication device either to an antenna or to test equipment is provided. The connector interface of this embodiment comprises an outer shell of conductive material, a probe of conductive material, and an intermediate spacer of non-conductive material. The wireless communication device comprises a signal bearing hollow antenna connector which connects to the outer shell of the connector interface during test. The probe passes through the hollow antenna connector to contact a ground potential within the body of the wireless communication device.

In another aspect of the present invention, a method of testing a wireless communication device is provided. In this method, the wireless communication device having an antenna interface is attached to a connector interface such that a first portion of the connector interface is electrically coupled to a grounded portion of the wireless communication device and a second portion of the connector interface is coupled to a signal portion of the wireless communication device. Test equipment is electrically coupled to the connector interface to test the functionality of the wireless communication device. The connector interface is detached from the antenna interface and an antenna is attached to the antenna interface. The wireless communication device is thereby tested without using radiated fields.

Accordingly, the present invention overcomes the longstanding problems in the art by providing a direct connection from a wireless device to test equipment through an existing connector on the device, thereby, eliminating the need for the use of radiated fields and the requirement of an additional port on the device.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Preferred embodiments of the present invention will now be described with reference to the accompanying figures. The terminology used in the description presented herein is intended to be interpreted in its broadest reasonable manner, even though it is being utilized in conjunction with a detailed description of certain specific preferred embodiments of the present invention. This is further emphasized below with respect to some particular terms. Any terminology intended to be interpreted by the reader in any restricted manner will be overtly and specifically defined as such in this specification.

Figure 1:
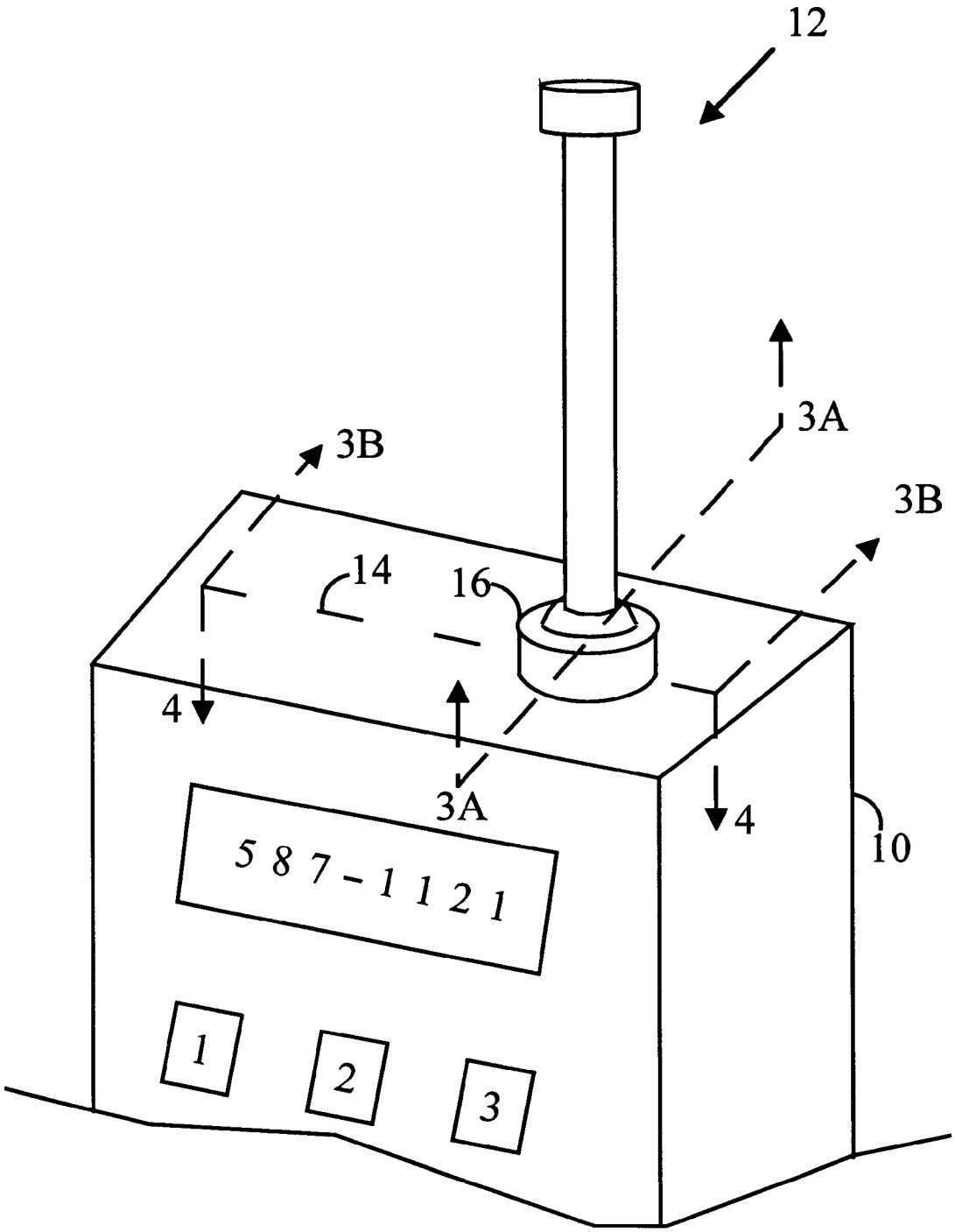
FIG. 1 is a perspective view of a portion of a wireless communication device and its associated antenna and antenna interface.

Referring now to FIG. 1, a wireless communication device 10 is illustrated. The device 10 may, for example, be a cellular telephone, although other wireless communication products such as wireless computer network equipment, automatic meter-reading equipment, and the like are also suitable for use in conjunction with the present invention. The device 10 includes a monopole whip antenna 12, which is attached to a device housing 14 through an antenna interface 16. Preferably, the antenna 12 is retractable and slides into the device housing 14 when retracted.

Figure 2:
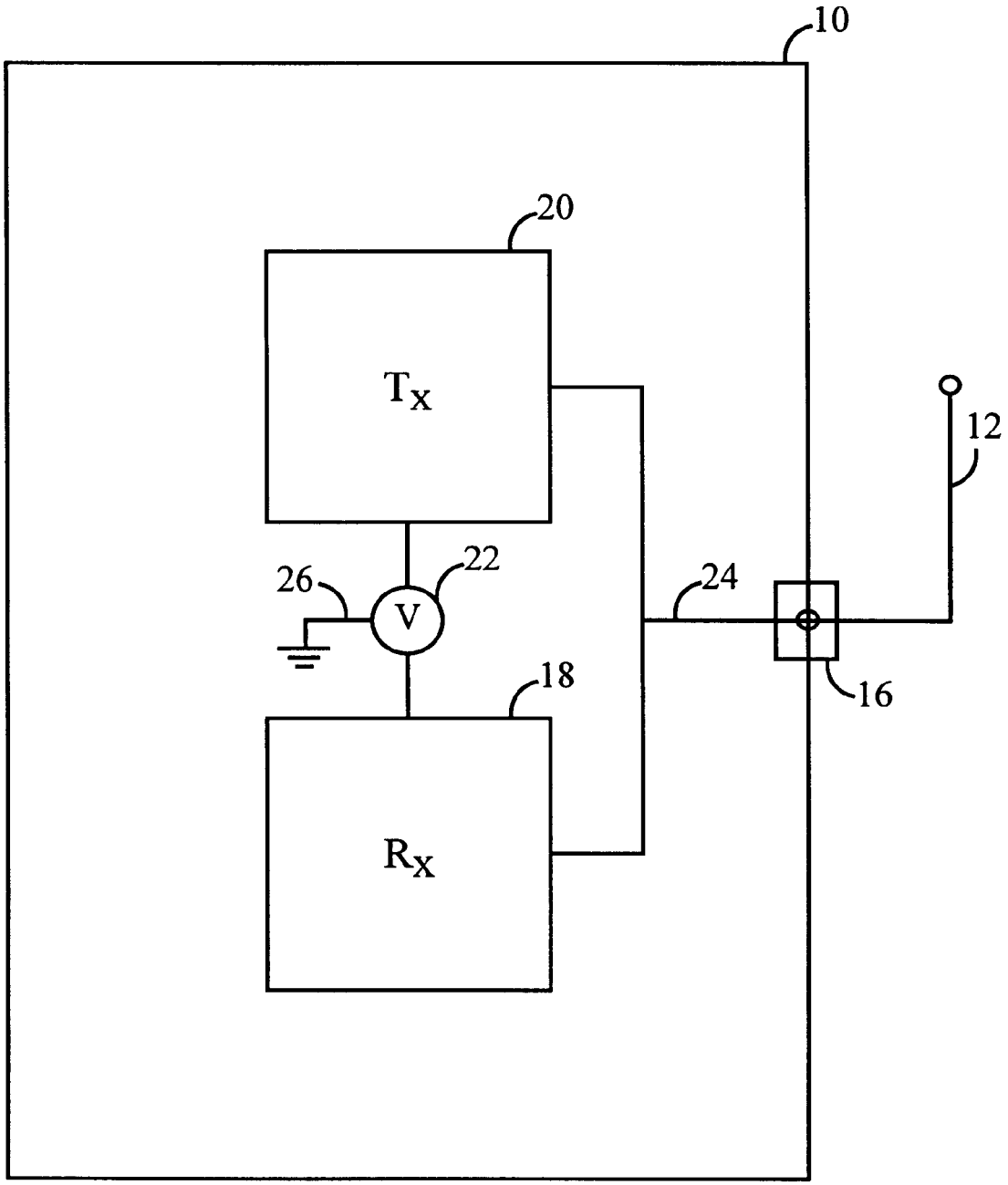
FIG. 2 is a block diagram of a portion of the internal circuitry of the wireless communication device of FIG. 1.

A representation of a portion of the functional circuitry inside the device 10 is shown in FIG. 2. The antenna 12 is coupled through the antenna interface 16 to a receive circuit 18 and a transmit circuit 20 which are powered by a power source 22. The power source 22 is typically an internal battery but may also comprise a connection to an external source of DC or AC power. A signal conductor 24 electrically couples the antenna 12 to the receive circuit 18 and the transmit circuit 20 when the antenna 12 is installed. Furthermore, a ground conductor 26 connects the ground of the device 10 to the ground of power source 22.

When a wireless communication device is manufactured, it is necessary to perform functional tests to ensure the proper operation of the device. Appropriate test equipment such as signal analyzers and RF power meters typically have a coaxial interface. One method which may be used to test a wireless communication device is to connect the test equipment to a testing antenna. The testing antenna is placed near the antenna of the wireless communication device (such as the antenna 12) during test procedures. Signals are thus radiatively coupled between the device and the test equipment. This procedure, however, has disadvantages in that coupling efficiency is dependent on the relative placement and orientation of the two antennas. Also, relatively high powered interference signals are likely to be present in the production environment where many devices are tested concurrently.

As an alternative, the test equipment can be connected directly to the device conductors such as directly coupling to the conductor 24 and the ground conductor 26 of the device 10. A physical interface of this type eliminates the use of radiative coupling and minimizes the disadvantages noted above. Several options exist to accomplish the direct connection. The test equipment could be directly attached to the conductor 24 at the antenna interface 16 without the use of a direct grounding attachment. However, such single conductor systems suffer from uncontrolled ground currents which produce large variations in coupling efficiency and undesired radiated energy. An alternative system may provide a separate "two wire" test port (i.e. a port providing both a ground and a signal connection) on the housing of the device which is dedicated to the attachment of test equipment. A dedicated test port increases the price of the device and decreases the performance and aesthetic appearance of the device.

Figure 3A:
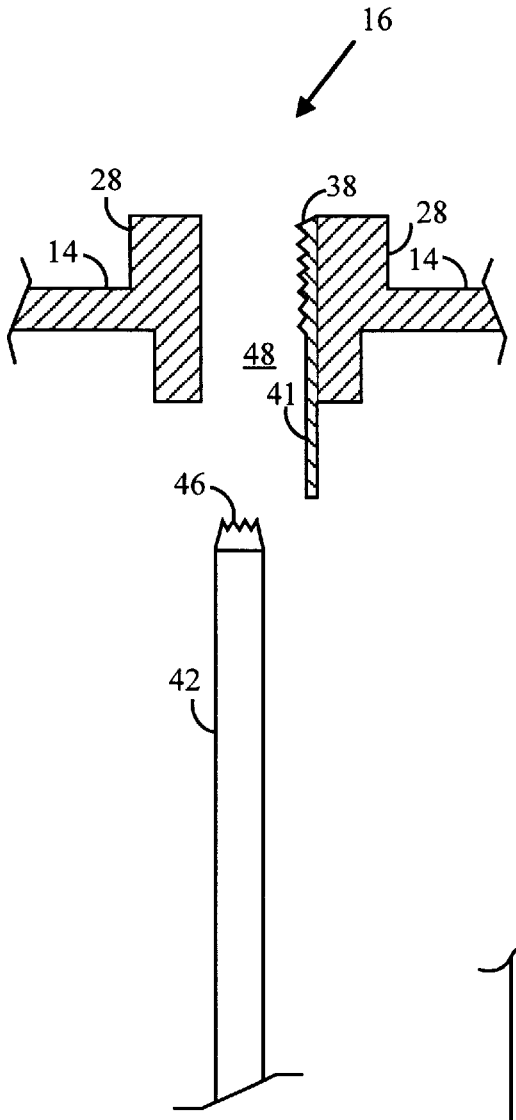
FIG. 3A is a cutaway side elevational view taken along lines 3A—3A of the wireless communication device of FIG. 1.

The present invention provides a device interface which functions as a two wire test port and an antenna port. FIG. 3A is a cutaway side elevational view taken along lines 3—3 of the wireless communication device of FIG. 1. The top panel of the housing 14 is preferably made from a polymer material and is most preferably molded to include an upwardly extending flange 28 having a circular axial cross section with respect to the longitudinal axis defined by the antenna 12. Secured to the interior surface of the flange 28 is a pseudo-cylindrical shell 38 made of conductive material which has a hollow interior defined by an interior surface 41 which may be at least partially threaded. A printed wiring board 42, having an electrical contact 46, may slide into the channel 48 formed by the pseudo-cylindrical shell 38, as described in greater detail below.

Figure 3B:
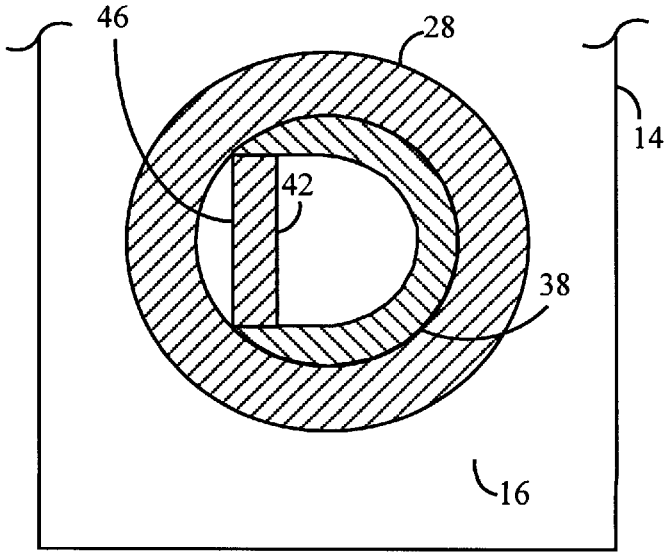
FIG. 3B is a sectional view of the antenna interface 16 taken along lines 3B—3B of the wireless communication device of FIG. 1.

FIG. 3B is a top view of the top panel of the housing 14 which shows the pseudo cylindrical shape of the opening in the antenna interface 16. The flange 28 has a circular cross section. However, the top view of the pseudo-cylindrical shell 38 shows its semicircular shape. In the prior art configuration, a cylindrical threaded conductive shell would reside within the flange 28 instead of the pseudo-cylindrical shell 38. The prior art cylindrical shell would mate to a thread portion of an antenna. For example, see the external threaded surface 59 of FIG. 4 described subsequently herein. However, in the present invention, a portion of the prior art cylindrical shell is missing. In the preferred embodiment approximately 90 degrees of the prior art cylindrical shell is missing, thus, creating the semicircular cross section of the pseudo-cylindrical shell shown in FIG. 3B. As will become evident as later figures are introduced herein, the missing section is of sufficient size to permit the entry of a ground probe associated with the connector interface during test while being small enough such that the remainder of the pseudo-cylindrical shell 38 provides a stable connection for a standard antenna during normal use.

FIG. 3A. shows the arrangement within the housing 14 with respect to the pseudo-cylindrical shell 38. A printed wiring board 42 is disposed within the housing 14. The printed wiring board 42 is mounted parallel to the plane defined by line 4—4 of FIG. 1 and FIG. 3B. Therefore, only the edge of the printed wiring board 42 is shown in FIG. 3A. The edge of the printed wiring board 42 is in alignment with the gap in the pseudo-cylindrical shell 38. Only the right side of pseudo-cylindrical shell 38 is shown as being in contact with flange 28, since the missing section referred to above appears on the left side. Referring again to FIG. 3B, a second edge of the printed wiring board 42 can be seen through the hollow center of the antenna interface 16. Also, an electrical contact 46 can be seen through the hollow center of the antenna interface 16. The electrical contact 46 is electrically connected to a ground plane on the printed wiring board 42 and is accordingly electrically tied to the ground conductor 26 as shown in FIG. 2. The utility of such an arrangement will be evident as further aspects of the current invention are described herein.

The pseudo-cylindrical shell 38 is electrically coupled to the receive circuit 18 and the transmit circuit 20. In the preferred embodiment, the receive circuit 18 and the transmit circuit 20 are located on the printed wiring board 42 and are attached to the pseudo-cylindrical shell 38 by means of a spring attachment which is not shown in the FIG. 3A.

In an alternative embodiment, the electrical contact 46 may comprise a portion of a mounting mechanism or other component within the housing 14 which is electrically coupled to a ground potential. In such a case, the position and function of the electrical contact 46 remain unchanged.

Figure 4:
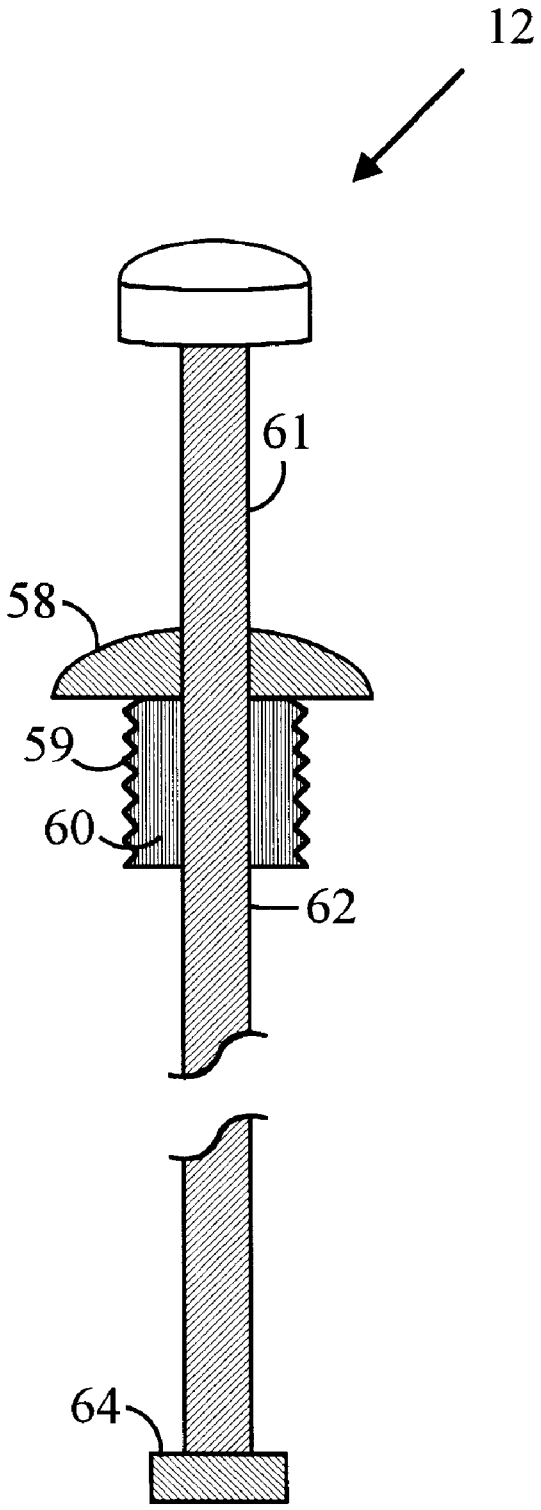
FIG. 4 is a cutaway view of a monopole whip antenna taken along lines 4—4 of the communication device of FIG. 1.

Referring now to FIG. 4, the coupling of a monopole whip antenna to the antenna interface 16 is described. FIG. 4 is a cutaway view of a monopole whip antenna taken along lines 4—4 of the communication device of FIG. 1. In general, the antenna 12 is symmetrical about its longitudinal axis. The antenna 12 is comprised of a conductive radiating portion 61 having an elongated rod shape. The radiating portion 61 may or may not be encapsulated in a polymer material for flexibility and may comprise a helical or other configuration which functions to minimize its physical length while retaining suitable radiating properties. Many other antenna configurations and designs are well known to those of skill in the art and are suitable for use with the present invention.

The antenna 12 comprises a nonconductive head portion 58 and a shaft portion 60 having an external threaded surface 59 which extends downward from the head portion 58. The head portion 58 and the shaft portion 60 define a channel 62 which extends longitudinally through the interior of the head portion 58 and the shaft portion 60 and through which the radiating portion 61 is slidably mounted. A cap 64 is located at the lower end of the radiating portion 61. When the conductive portion 61 is extended, the cap 64 makes contact with the shaft portion 60 thereby electrically connecting the radiating portion 61 to the shaft portion 60.

Figure 5:
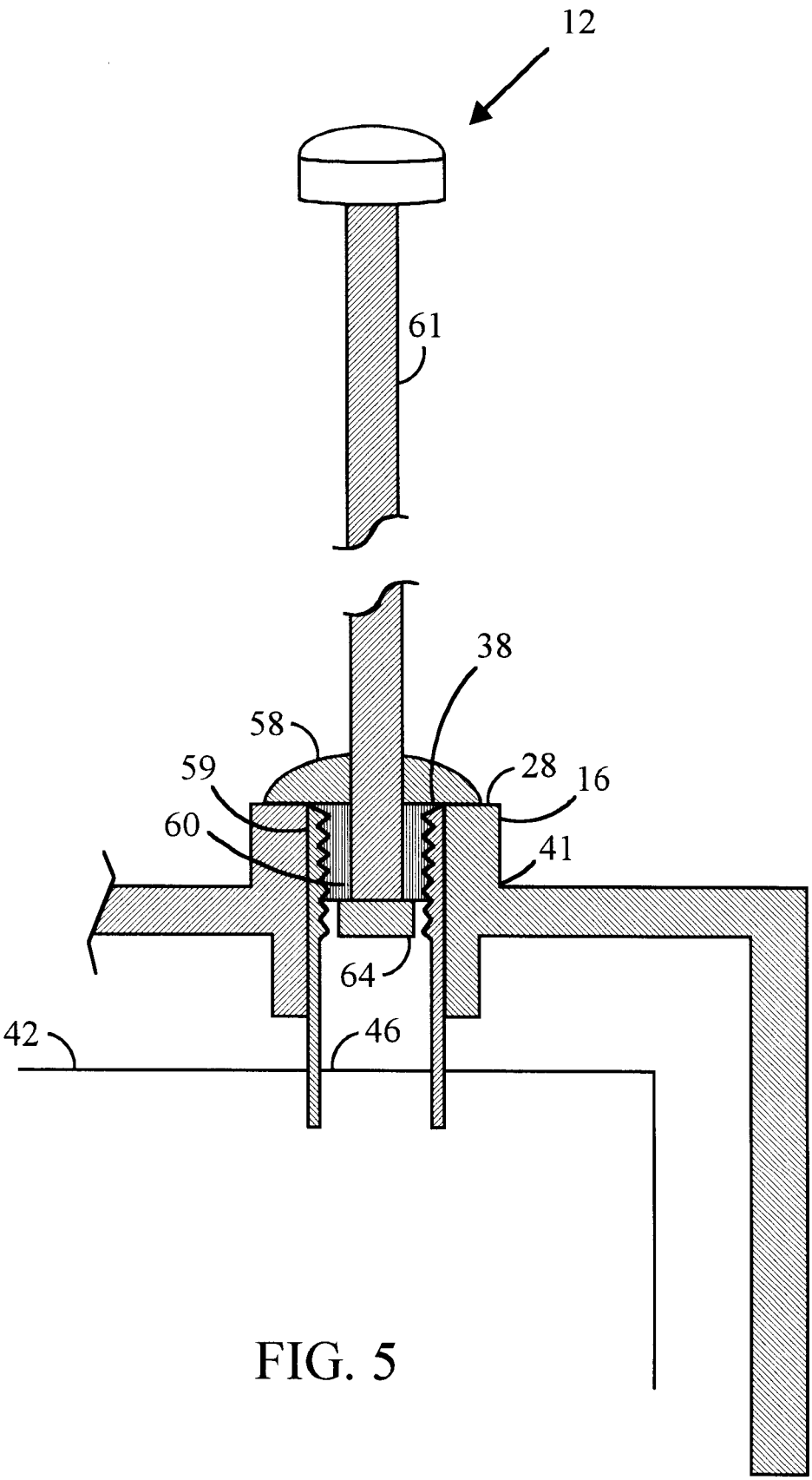
FIG. 5 is a cutaway view of the monopole whip antenna of FIG. 4 installed in the antenna interface taken along lines 4—4 of FIG. 1.

FIG. 5 illustrates the antenna 12 coupled to the antenna interface 16 for general use. FIG. 5 comprises a cutaway view of the antenna interface 16 as shown taken along lines 4—4 of FIG. 1. The external threaded surface 59 of the shaft portion 60 mates with the threads on the interior surface 41 of the pseudo-cylindrical shell 38. Because the antenna 12 is slidable, it may be retracted within the housing 14. For increased RF performance, however, the antenna 12 may be extended (as shown in FIG. 5) such that the top surface of the cap 64 electrically connects to the radiating portion 61 and the shaft portion 60 by physically engaging the bottom surface of the radiating portion 61 and the shaft portion 60. Preferably, the connection of the cap 64 to the radiating portion 61 and the shaft portion 60 incorporates a positive engagement so that the user can feel when the antenna 12 is fully extended.

When the antenna 12 is retracted, the conductive portion 61 extends down into the housing 14. Referring once again to FIGS. 3A and 3B, note that the printed wiring board 42 is positioned offset by some distance from the axial center of the antenna interface 16. Due to the offset, a channel 48 is formed which extends along the line defined by the axial center of the antenna interface 16 down into the housing 14. When the antenna 12 is retracted, the conductive portion 61 extends down into the channel 48. Also note that the grounded electrical contact 46 is offset from the line defined by the axial center of antenna interface 16 by a sufficient distance such that the conductive portion 61 does not contact the grounded electrical contact 46, even when the antenna 12 is in the retracted position. Also shown in FIG. 5 is a flat surface of the printed wiring board 42.

As discussed above, according to the present invention, the antenna interface 16 can also be used to provide a two wire test equipment interface for convenient and accurate testing of the device 10. The connection is accomplished with the use of a connector interface 68 illustrated in FIG. 6A. The connector interface 68 is used to adapt the antenna interface 16 to a standard connector. The connector interface 68 is comprised of a printed circuit board 70, a custom connector piece 66 and a printed circuit board (PCB) to coaxial connector 84. When the device 10 is under test, the custom connector 66 mates with the device 10 and the PCB to coaxial connector 84 is attached to the test equipment.

Figure 6A:
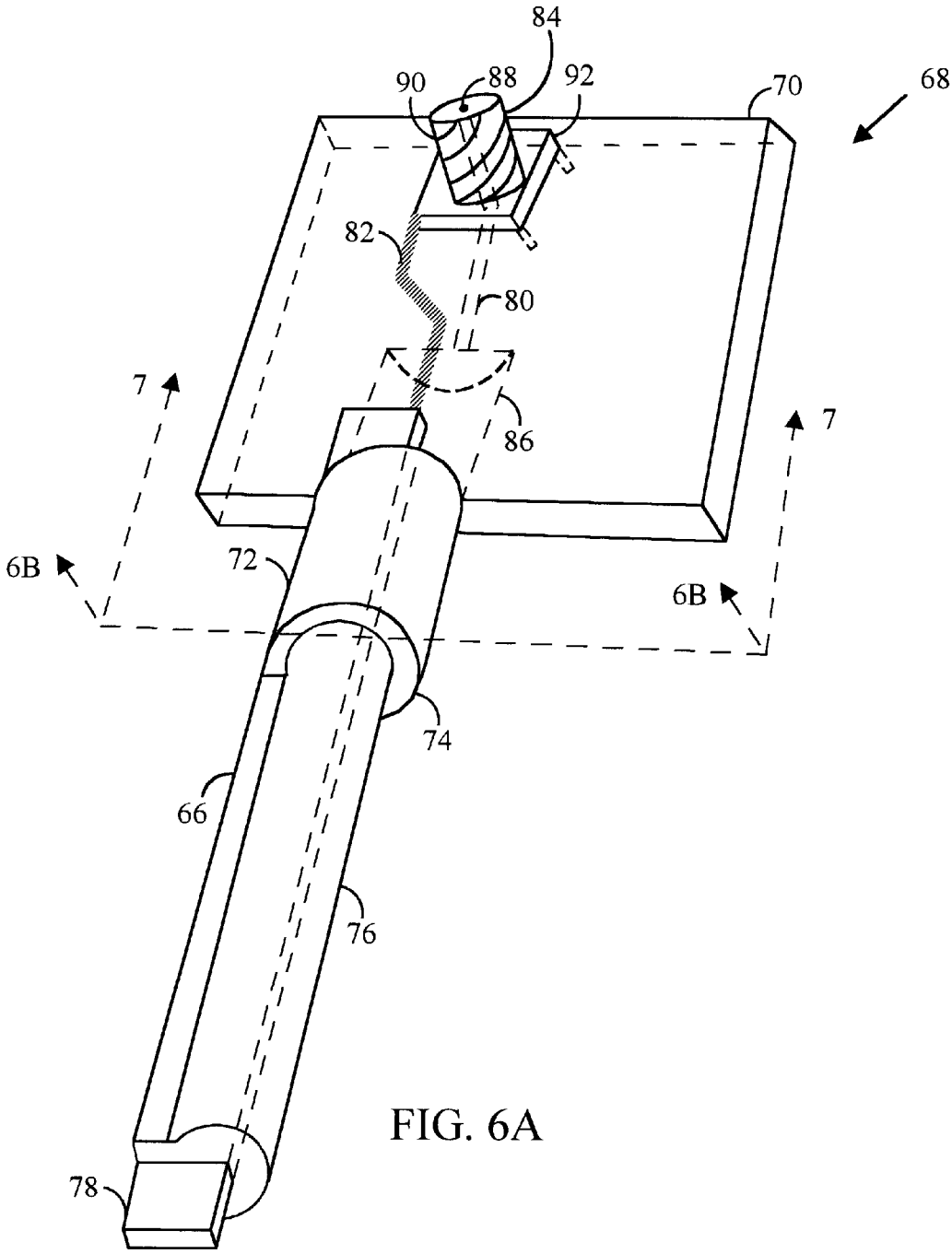
FIG. 6A is a perspective view of a connector interface of the present invention.

The custom connector piece 66 is comprised of three pieces: an outer conductive shell 72, a nonconductive spacer 76 and a ground probe 78. The custom connector piece 66 is mounted upon the printed circuit board 70 as described below. In FIG. 6A, the custom connector piece 66 is shown as side mounted such that an imaginary center axis of the custom connector piece 66 is parallel to the plane of the printed circuit board 70.

Figure 6B:
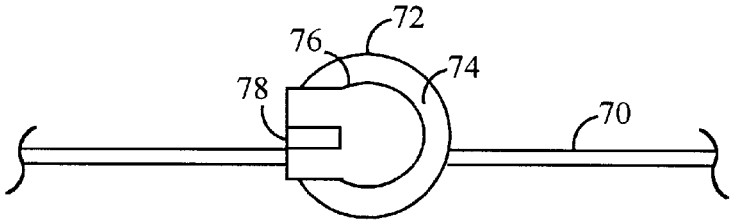
FIG. 6B is a sectional view of the connective interface of the present invention taken along the lines 6B—6B of FIG. 6A, and showing the relative position of the edge of printed circuit board 70 in the background.

The exterior of the outer conductive shell 72 has a substantially circular axial cross section. The circular nature of the outer conductive shell 72 is interrupted by a gap. Both the ground probe 78 and the nonconductive spacer 76 occupy the area defined by the gap. The semicircular shape of the outer conductive shell 72 is readily seen with reference to FIG. 6B. FIG. 6B is a side view of the connector interface 68. The size and shape of the gap in the outer conductive shell has a similar size and shape to the gap in the pseudo-cylindrical shell 38 best shown in FIG. 3B. The interior surface of outer conductive shell 72 may comprise any convenient shape which generally defines a pseudo-cylindrical center and which accommodates transverse disposal of the ground probe 78 therein.

The outer conductive shell 72 has a flattened and angled edge 74 which mates with the pseudo-cylindrical shell 38 of the device 10 as is subsequently herein shown in FIG. 7. This mating between shells 72 and 38 is shown as taking place only on the right side, since shell 72 (see FIG. 6B) and shell 38 (see FIG. 3B) are both pseudo-cylindrical.

A semicircular flange 86 portion of the outer conductive shell 72 extends beneath the printed circuit board 70 and is soldered or otherwise mechanically and electrically connected to a trace 80 on the printed circuit board 70. The flange 86 is shown in dashed lines in FIG. 6A to indicate that the flange 86 is beneath the printed circuit board 70 in the orientation shown in FIG. 6A. The outside surface of the flange 86 continues the shape of the outer conductive shell 72. The inner surface of the flange 86 which is soldered to the board has a rectangular shape. The trace 80 conforms to the shape of the inner surface of the flange 86 in the area where contact between the printed circuit board 70 and the flange 86 is made. The trace 80 extends beyond the flange 86 on the printed circuit board 70 to provide connection to the PCB to coaxial connector 84. The trace 80 is shown in dashed lines to indicate that the trace 80 is printed on the underside of the printed circuit board 70 in the orientation shown in FIG. 6A.

In the preferred embodiment, the ground probe 78 has a rectangular face which mates with the electrical contact 46. The ground probe 78 has a straight rectangular rod shape that protrudes from the outer face of the nonconductive spacer 76 and extends through the custom connector 66 and past the edge of the printed circuit board 70 above the flange 86. The distance separating the ground probe 78 and the flange 86 is equal to the thickness of the printed circuit board 70 such that the ground probe 78 contacts the printed circuit board 70 directly on the other side of the printed circuit 70 from the flange 86, thus, providing a stable mechanical connection between the printed circuit board 70 and the custom connector piece 66. The ground probe 78 is soldered or otherwise mechanically and electrically connected to a ground trace 82 printed on the top side of the printed circuit board 70, thus, providing a mechanical as well as electrical connection between the custom connector 66 and the printed circuit board 70. The ground trace 82 conforms to the rectangular shape of the ground probe 78 in the area where contact between the printed circuit board 70 and the ground probe 78 is made. The ground trace 82 extends beyond the ground probe 78 to provide a connection along the printed circuit board 70 to the PCB to coaxial connector 84. In the preferred embodiment, the ground trace 82 expands to provide a reference ground plane for the trace 80 and, thereby, establishes the characteristic impedance of the trace 80.

In the most general embodiment, the custom connector 66 may be mounted in any fashion including a top mounted configuration. In a top mounted configuration, an imaginary center axis of the custom connector 66 is perpendicular to the plane of the printed circuit board 70. In such a configuration, a set of prongs extends from the outer conductive shell 72 through the printed circuit board 70 so that the prongs could be soldered or otherwise mechanically and electrically connected to the underside of the printed circuit board 70. Likewise, the ground probe 78 would extend through printed circuit board 70 such that it could be soldered or otherwise mechanically and electrically connected to the underside of the printed circuit board 70. The remaining features of the invention are directly applicable to such a top mounted configuration.

Referring again to the preferred embodiment shown in FIG. 6A, the PCB to coaxial connector 84 is shown as an SMA connector mounted perpendicular to the printed circuit board 70. The PCB to coaxial connector 84 is comprised of a center conductor 88 which extends through the printed circuit board 70 and is soldered to the trace 80 on the underside of the printed circuit board 70 in the orientation shown in FIG. 6A. In this way, a signal connection is made from the outer conductive shell 72 to the flange 86 to the trace 80 of the PCB to the center conductor 88 of coaxial connector 84.

The coaxial connector 84 also comprises a threaded cylindrical shell 90. The threaded cylindrical shell 90 is supported by and electrically connected to a four pronged base 92. The four prongs of the four pronged base 92 extend through the printed circuit board 70 and at least one of the prongs is soldered to a through hole pad connection on underside of the printed circuit board 70. The through hole pad connection is electrically coupled to the ground trace 82. In this way, a ground connection is made from the ground probe 78 to the ground trace 82 of the PCB to the threaded cylindrical shell 90 of coaxial connector 84. The test equipment setup (not shown in FIG. 6A) engages the threaded cylindrical shell 90 and the center conductor 88 of the PCB to coaxial connector 84 during the testing process.

A nonconductive spacer 76 is disposed within the hollow center portion of the outer conductive shell 72 and extends along the length of the ground probe 78. The nonconductive spacer 76 preferably comprises a dielectric material. Within the outer conducive shell 72, the nonconductive spacer 76 may define any convenient form which generally comprises a pseudo-cylindrical shape that mates with the hollow center of the outer conductive shell 72 to provide a secure mechanical connection. Preferably, the nonconductive spacer is constructed from a dielectric material and provides a matched impedance for the signal carried by the outer conductive shell 72. The nonconductive spacer 76 may extend along the length of the ground probe 78 to add strength to the custom connector 66. In FIG. 6A the shape of the nonconductive spacer 76 is shown to be semi-circular in nature along the length of the ground probe 78 which extends beyond the outer conductive shell 72. In FIG. 6B, it can be seen that the conductive spacer 76 provides electrical and mechanical isolation of the ground probe 78 and the outer conductive shell 72.

The nonconductive spacer 76 also has an opening in the exposed face that extends parallel to an imaginary center axis of the custom connector 66. The ground probe 78 extends through the opening and beyond the nonconductive spacer 76 on each side of the nonconductive spacer 76. The ground probe 78 is mounted substantially parallel to but offset from the imaginary axial center of the outer conductive shell 72. The ground probe 78 may be fixed in length. Alternatively, the ground probe 78 may be spring mounted such that the end of the ground probe 78 which extends away from the printed circuit board 70 may be displaced relative to the remainder of the connector interface 68 from a resting position by the application of force.

Figure 7:
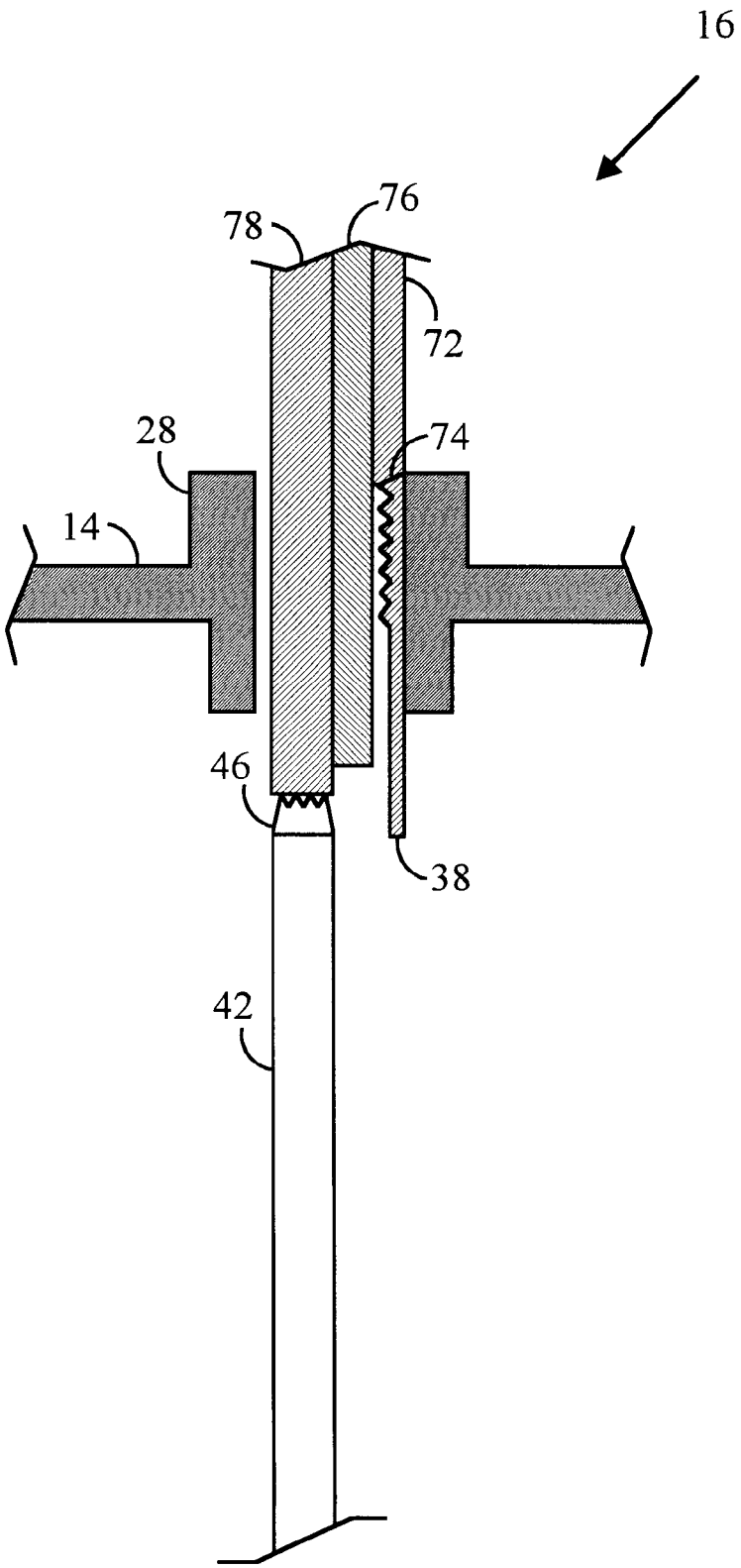
FIG. 7 is a cutaway view of taken along lines 7—7 of FIG. 6A, illustrating the connector interface installed in the antenna interface of FIG. 3.

FIG. 7 shows the connector interface 68 as it is installed on device 10. A better understanding of the mating process can be seen by comparing FIG. 3B to FIG. 6B. The antenna interface 16 receives the ground probe 78 through the gap in the pseudo-cylindrical shell 38. In FIG. 7, the view of the connector interface 68 is taken along the line 7—7 of FIG. 6A. The view of the device 10 is taken along lines 3—3. Note that the flattened and angled edge 74 of the outer conductive shell 72 contacts the pseudo-cylindrical shell 38 so as to provide a signal connection to the connector interface 68. The ground probe 78 extends down through the device housing 14 to make contact with the grounded electrical contact 46. In this way a two wire connection is made according to the present invention. Note that the nonconductive spacer also extend through the pseudo-cylindrical shell 38 into the interior of the housing 14 and provides isolation between the ground probe 78 and the pseudo-cylindrical shell 38.

In one preferred embodiment, the device 10 is mounted in a test fixture which determines and stabilizes the position of the device 10. The connector interface 68 may be attached to a linear motion positioner which allows secure and pressured placement of the connector interface 68 against the device 10. Preferably, the linear motion positioner moves the connector interface 68 along the axis of the outer conductive shell 76. A pressure mechanism, such as an Archimedean thread, applies sufficient pressure to the connecter interface 68 against the device 10 to ensure a stable connection. A small motor or a worm gear device may be used to provide the motion of the linear motion positioner.

Alternatively, the connector interface 68 may be a firmly attached portion of a test fixture. In such an arrangement, the device 10 is moved to fit against the connector interface 68. For example, the device 10 may slip and snap securely into position and be readily movable upon the completion of test. A form of spring pressure may be exerted against the device 10 in order to ensure a stable connection between the connector interface 68 and the device 10.

Figure 8:
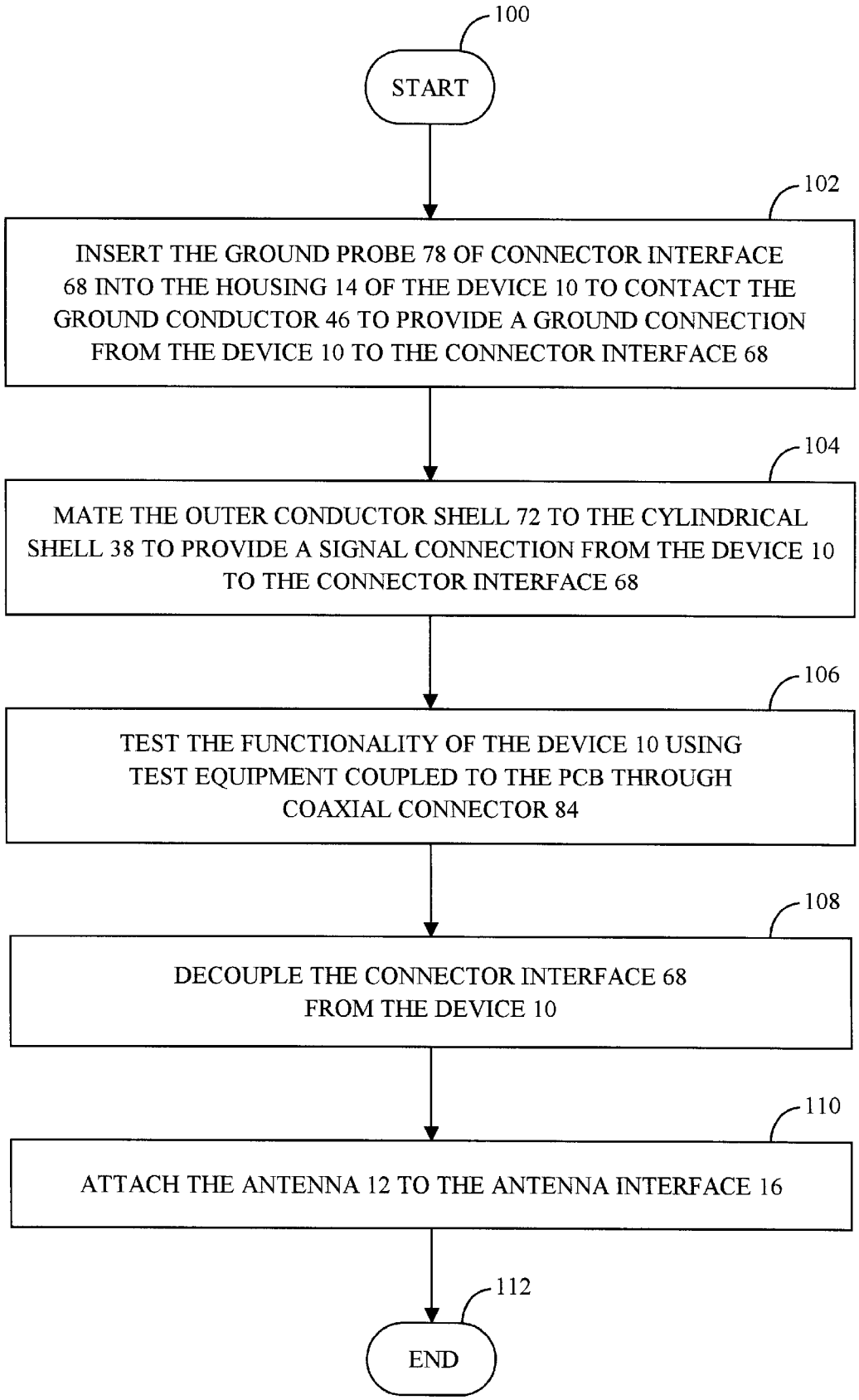
FIG. 8 is a flow chart showing a method of testing a device according to the present invention.

The present invention also envisions a method for testing a wireless communication device as detailed in the flow chart of FIG. 8. The flow begins in start block 100. In block 102, the ground probe 78 of the connector interface 68 is inserted into the housing 14 of the device 10 to contact the grounded electrical contact 46. In this way, a ground connection between device 10 and the connector interface 68 is established. In block 104, the outer conductive shell 72 of the connector interface 68 is mated to the cylindrical shell 38 of the antenna interface 16 of the device 10. In this way, a signal connection between device 10 and the connector interface 68 is established. Thus, a two wire connection between the device 10 and the connector interface 68 has been established.

In block 106, the functionality of device 10 is tested. The test equipment which executes the testing process is coupled to the connector interface 68 through the PCB to coaxial connector 84. Thus, the connector interface 68 provides a direct two wire interface from the test equipment to the device 10.

In block 108, after testing is completed the connector interface 68 is decoupled from the device 10 including the extraction of the ground probe 78 from within the housing 14. In block 110, the antenna 12 is connected to the antenna interface 16. Thus, the testing of device 10 is complete and the process ends in end block 112.

The present invention has been described with respect to a wireless communication device which both receives and transmits signals. The general principles described herein are directly applicable to a system in which communication refers only to either reception or transmission capability without modification of the principles described herein.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. A connector interface for providing direct connection from a wireless communication device to a coaxial connector, said connector interface comprising:

an outer conductive shell having a hollow center and a cross section which defines a gap, said gap extending along at least a portion of the length of said outer conductive shell;

a nonconductive spacer disposed within said hollow center of said outer conductive shell and extending into said gap; and a ground probe disposed parallel to, but offset from, a center axis of said hollow center and separated from said outer conductive shell by said nonconductive spacer;

wherein when said connector interface is connected to said wireless communication device, said outer conductive shell contacts an antenna connector mounted on said wireless communication device, and said ground probe extends through an opening in said antenna connector to electrically couple said ground probe to a ground potential in said wireless communication device.

2. The connector interface of claim 1 further comprising:

a printed circuit board upon which said outer conductive shell is mounted;

a signal trace electrically connected to said outer conductive shell and printed on said printed circuit board;

a ground trace connected to said ground probe and printed on said printed circuit board; and a coaxial to printed circuit board connector mounted on said printed circuit board and electrically coupled to said signal trace and said ground trace.

3. The connector interface of claim 2, wherein said outer conductive shell further comprises a flange which extends beyond said hollow center and contacts a portion of said printed circuit board, and wherein a portion of said ground probe extends from said hollow center to contact said printed circuit board on an opposite side of said printed circuit board from said flange.

4. The connector interface of claim 3, wherein a distance separating said flange and said portion of said ground probe is equal to a thickness of said printed circuit board.

5. The connector interface of claim 4, wherein said ground probe has a rectangular cross section.

6. The connector interface of claim 1, wherein said cross section of said outer conductive shell is semi-circular.

7. The connector interface of claim 1, wherein said gap in said cross section of said outer conductive shell corresponds to a gap on a threaded conductive portion of said antenna connector such that when said connector interface is connected to said wireless communication device, said ground probe extends through said gap on said threaded conductive portion of said antenna connector.

8. The connector interface of claim 1, wherein said nonconductive spacer is comprised of a dielectric material and provides a matched impedance for a signal carried between said antenna connector and said outer conductive shell.

9. The connector interface of claim 1, wherein said ground probe is spring mounted.

10. The connector interface of claim 1, wherein said nonconductive spacer extends at least partially along the length of a portion of said ground probe which extends beyond said hollow center to couple with said ground potential within said wireless communication device.

11. The connector interface of claim 1 wherein said ground potential is an exposed ground potential on a circuit board disposed within a housing for said wireless communication device.

12. The connector interface of claim 2 wherein said ground potential is a conductive portion of a mounting mechanism within a housing for said wireless communication device.

13. The connector interface of claim 1 wherein said standard coaxial to printed circuit board connector is an SMA to PCB connector.

* * * * *